United States Patent [19]

Aoki

[11] 4,276,532

[45] Jun. 30, 1981

[54] THERMAL FUSE

[75] Inventor: Shigeru Aoki, Takatsuki, Japan

[73] Assignee: Murata Manufacturing Co., Ltd., Japan

[21] Appl. No.: 52,816

[22] Filed: Jun. 27, 1979

[30] Foreign Application Priority Data

Jul. 8, 1978 [JP] Japan ..... 53-94485[U]
Sep. 27, 1978 [JP] Japan ..... 53-133298[U]

[51] Int. Cl.[3] ..... H01H 37/76
[52] U.S. Cl. ..... 337/408; 337/407
[58] Field of Search ..... 337/408, 409, 407, 403

[56] References Cited

U.S. PATENT DOCUMENTS

| | | | |
|---|---|---|---|
| 3,309,481 | 3/1967 | Merrill | 337/403 |
| 3,778,742 | 12/1973 | Merrill | 337/407 |
| 4,060,787 | 11/1977 | Budnik | 337/408 |

*Primary Examiner*—Harold Broome

*Attorney, Agent, or Firm*—Ostrolenk, Faber, Gerb & Soffen

[57] ABSTRACT

This disclosure relates to a heat fuse for use in electrical and electronic equipment in which a contact plate having a diameter smaller than the internal diameter of a metallic casing is adapted to positively contact under pressure the inner peripheral surface of the metallic casing by the component force produced at the forward end of a second compression spring and applied in a direction perpendicular to the direction of the compression force. The contact plate can be pressed against the peripheral inner surface of the metallic casing with a sufficiently large contact pressure by the component force of the second compression spring, while the friction caused by the sliding movement of the contact plate with respect to the casing during functioning is extremely small owing to the diameter of the contact plate made smaller than the internal diameter of the metallic casing.

14 Claims, 14 Drawing Figures

THERMAL FUSE

BACKGROUND OF THE INVENTION

The present invention relates to an electrical fuse and more particularly, to a thermal fuse for use in various electrical and electronic equipment so as to prevent the equipment from overheating.

The thermal or temperature fuse is an electrical safety device including a fusible material that melts by heat so as to interrupt functioning of a circuit when electric current passing therethrough becomes excessively large, and has been widely employed in various electrical and electronic equipment and appliances for protecting them against possible damage due to overheating.

Conventionally, as shown in FIG. 1(*a*), the known thermal fuse includes, for example, a cylindrical metallic casing 10 open at its one end 10*a*, a normally solid temperature-sensing fusable pellet 11 filled to a predetermined thickness, in the other end 10*b* of the casing 10 so as to be melted at a predetermined temperature for collapsing an electrically non-conductive bush member or end plug 14, for example, of ceramic material through which a lead wire or conductor 12 provided with a contact portion 12*a* at its forward end axially extends and which is filled into the open end 10*a* of the case 10 for closing said end 10*a* by application of sealing resin 13 thereonto a slidable contact member 15 having a configuration as shown in FIG. 1(*b*) formed by providing a plurality of notches n around a peripheral edge of a circular disc (not shown) to leave the corresponding number of resilient projections or blades 15*a* extending outwardly from a main portion 15*b* of the contact member 15 to be directed in one direction as shown and slidably disposed within the casing 10 between the fusible pellet 11 and bush member 14, with the blades 15*a* thereof contacting under pressure the inner peripheral surface of the casing 10 by the resiliency of the blades 15*a* for electrical conduction therebetween, a first compression spring 16*a* held under compression between the slidable contact member 15 and bush member 14, and a second compression spring 16*b* having spring force sufficiently larger than that of the first spring 16*a* and also held under compression between the contact member 15 and fusible pellet 11 through metallic discs 17*a* and 17*b* respectively.

In the conventional arrangement as described above, when the electrical appliance equipped with said thermal fuse is normally working without overheating, the slidable contact member 15 is caused to contact under pressure the contact portion 12*a* of the lead wire 12 by the urging force of the second compression spring 16*b* for electrical conduction of the lead wire 12 with another lead wire 18 extending outwardly from the other end or bottom 10*b* of the casing 10, through the metallic casing 10, contact member 15 and contact portion 12*a*. Meanwhile, when the electrical appliance is overheated due to some trouble, the heat generated thereby melts the fusible pellet 11 to collapse for releasing the second compression spring 16*b* from its compressed state as shown in FIG. 1(*c*), and thus, the contact member 15 is shifted to the side of the second compression spring 16*b* by the spring force of the first compression spring 16*a* to disconnect the contact member 15 from the contact portion 12*a* for cutting off the electrical conduction between the lead wires 12 and 18.

Although the prior art thermal fuse as described in the foregoing is capable of increasing the accuracy for rated temperature thereof with favorable characteristics in variation with time since the melting temperature of the fusible pellet 11 is extremely stable, friction caused by the sliding movement of the contact member 15 within the casing 10 tends to be increased especially when the thermal fuse is formed into a small size, and for achieving positive cutting off of electrical conduction between the lead wires 12 and 18 through smooth sliding movement of the first compression spring 16*a* upon melting of the fusible pellet 11, higher standards are required for the configuration, dimensions, materials, etc. of the slidable contact member 15, thus giving rise to difficulties in the manufacture of the slidable contact member or incorporation thereof into the metallic casing 10 or in the reduction of the diameter of the heat fuse.

Another disadvantage inherent in the known thermal fuse of the above described type is such that, since the lead wire 12 is fixed to the bush member 14 only by the sealing resin 13, if the bonding between the lead wire 12 and sealing resin 13 is imperfect, the lead wire 12 moves in the axial direction of the bush member 14 after the melting of the fusible pellet 11 to cause the contact portion 12*a* to again contact the slidable contact member 15 for undesirable electrical conduction between the lead wires 12 and 18.

SUMMARY OF THE INVENTION

Accordingly, an essential object of the present invention is to provide an improved thermal fuse for use in electrical and electronic equipment which has small sliding friction caused by a contact member thereof even when the heat fuse is made into a compact size, while providing sufficient contact pressure for perfect electrical conduction during normal use.

Another important object of the present invention is to provide an improved thermal fuse of the above described type in which undesiraable re-connection between lead wires thereof upon collapsing of a fusible pellet is prevented through a novel lead terminal fixing structure.

A further object of the present invention is to provide an improved thermal fuse of the above described type which is accurate in functioning and simple in construction, and can be manufactured on a large scale at low cost.

In accomplishing these and other objects, according to one preferred embodiment of the present invention, there is disclosed a thermal fuse for use in electrical and electronic equipment which includes a metallic casing open at its one end and having a first conductor extending outwardly from the other closed end thereof, an end plug member of electrically insulative material to be filled into the open one end of the metallic casing, a second conductor axially extending through and fixed in the end plug, with an electrical contact portion which is formed at one end of the second conductor projecting into the metallic casing, a contact plate member urged toward the electrical contact portion of the second conductor by a first compression spring and a fusible member to be melted at temperatures exceeding predetermined level which are accommodated between the electrical contact portion of the second conductor and the other closed end of said metallic casing, and a second compression spring so constructed as to have spring force smaller than that of the first compression spring and to produce component force at its forward end, in a direction perpendicular to direction of compression force applied to the second compression spring. The second compression spring is held under compression between the contact plate and end plug member with the forward end of said second compression spring being directed to the side of the contact portion of the second conductor, and thus, the contact plate is pressed at its outer peripheral face, against the inner peripheral face of the metallic casing.

By the arrangement of the present invention as described above, an improved thermal fuse having a small sliding friction caused by the contact member and yet capable of providing sufficient contact pressure for good electrical conduction during normal use has been advantageously presented, with substantial elimination of disadvantages inherent in the conventional arrangements of the kind.

BRIEF DESCRIPTION OF THE DRAWINGS

These and other objects and features of the present invention will become apparent from the following description taken in conjunction with the preferred embodiment thereof with reference to the accompanying drawings, in which, FIG. 1(*a*) is a side sectional view showing the construction of a conventional thermal fuse (already referred to), FIG. 1(*b*) is a perspective view showing, on an enlarged scale, a slidable contact member employed in the thermal fuse of FIG. 1 (already referred to), FIG. 1(*c*) is a view similar to FIG. 1(*a*), which is particularly explanatory of the function of the thermal fuse of FIG. 1.

Before the description of the present invention proceeds, it is to be noted that like parts are designated by like reference numerals throughout several views of the accompanying drawings.

DETAILED DESCRIPTION OF THE INVENTION

Figure 1A:
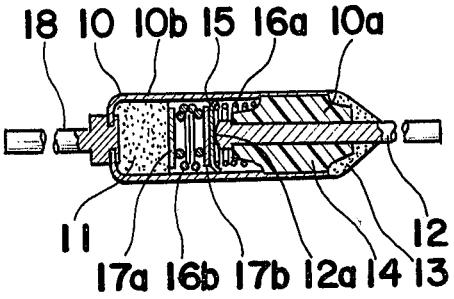
Fig. 1(a) PRIOR ART
Figure 1B:
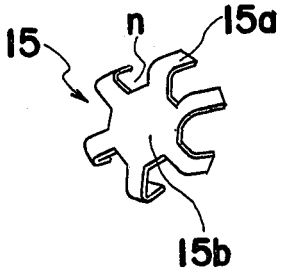
Fig. 1(b) PRIOR ART
Figure 1C:
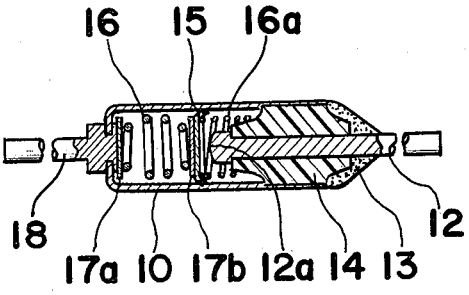
Fig. 1(c) PRIOR ART
Figure 2:
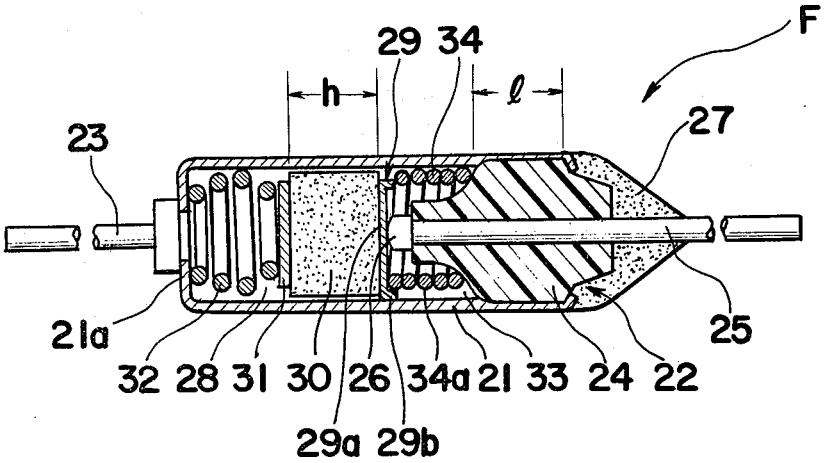
FIG. 2 is a side sectional view showing the construction of an improved thermal fuse according to one preferred embodiment of the present invention.

Referring now to the drawings, there is shown in FIG. 2 a thermal fuse F according to one preferred embodiment of the present invention, which generally includes a cylindical metallic casing 21 formed, for example, by pressing of a metallic plate with a high conductivity such as brass or the like, and open at its one end 22, with a conductor or lead wire 23 being caulked or staked to the other end or bottom portion 21*a* of the metallic casing 21 so as to extend outwardly at right angles from a central portion of the bottom portion 21*a*, a bush member or plug 24 of electrically non-conducting insulative resin, ceramic material or the like formed into a shape with dimensions that can be fitted into the open end 22 of the metallic casing 21 for serving as an end plug of said casing 21, and another conductor or lead wire 25 axially extending through the bush member 24 to be fixed thereat so that a contact portion 26 provided at one end of the lead wire 25 extends into the casing 21 as shown. In the inner surface of the metallic casing 21, the internal diameter of the portion extending over a distance l from the edge of the open end 22 is made larger than that of the remaining portion for fitting the large-diameter main portion of the bush member 24 thereinto, while the peripheral portion of the edge of the open end 22 is drawn or bent inwardly for fixing the bush member 24 in the above mentioned portion having the length l of the metallic casing 21 which is further sealed by application of sealing resin 27, for example, epoxy resin and the like.

Figure 3:
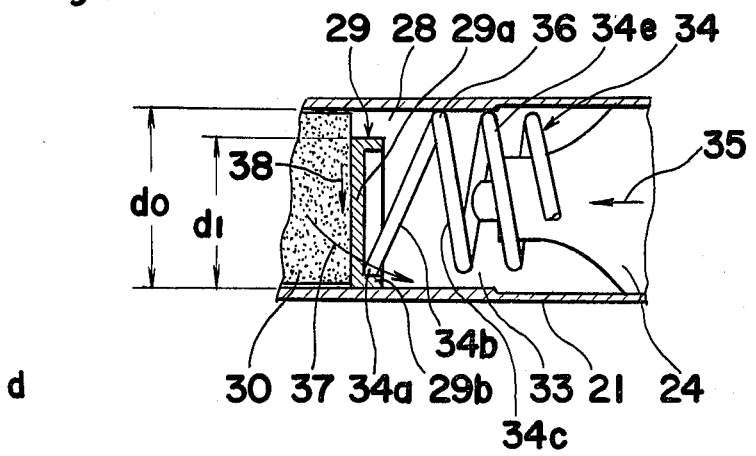
FIG. 3 is a fragmentary sectional view showing on an enlarged scale, a main portion of the thermal fuse FIG. 2, and particularly explanatory of component of force acting on a contact plate upon compression of a second compression spring, FIGS. 4(*a*) and 4(*b*) are side sectional views on an enlarged scale, of the second compression spring employed in the thermal fuse of FIG. 2, which particularly show the states thereof before and after compression.
Figure 4A:
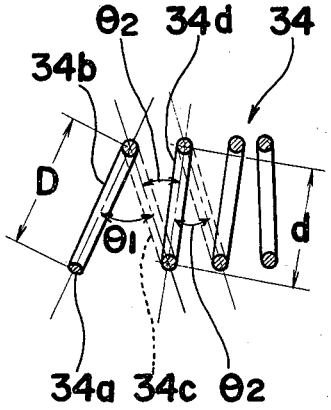
Figure 4B:
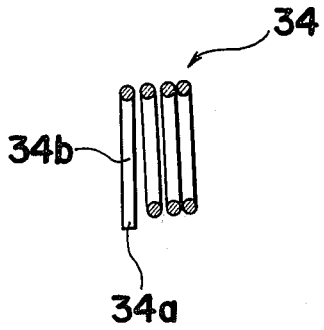

As shown in FIG. 3, the metallic casing 21 further includes in its space 28 between the bottom portion 21*a* thereof and the contact portion 26 of the lead wire 25, a contact plate 29 of dish-like shape having its external diameter $d_1$ smaller than the internal diameter $d_0$ of the metallic casing 21 and fitted in the space 28 in such a manner that a bottom portion 29*a* of the contact plate 29 is directed toward the bottom portion 21*a* of the metallic casing 21. Moreover, in the space between the contact plate 29 and the bottom portion 21*a* of the metallic casing 21, an organic fusible member 30 formed into a column with a height of h and arranged to melt or collapse at a predetermined temperature is fitted, while a first compression coil spring 32 is disposed in a compressed state between a disc member or washer plate 31 contacting the fusible member 30 and the bottom portion 21*a* of the metallic casing 21 for urging by the spring force thereof, the contact plate 29 to contact the contact portion 26. On the other hand, in a space 33 defined in the casing 21 between the contact plate 29 and bush member 24, a second compression spring 34 of coil shape as shown in FIG. 4(*a*) and having spring force smaller than that of the first compression spring 32 is held under compression. The second compression spring 34 is so formed that its diameter D at a portion 34*b* thereof at least half a turn from its forward end 34*a* is larger than a diameter d at its subsequent portion 34*c*, and that an angle $\theta$, formed by the portion 34*b* and the subsequent portion 34*c* is larger than the angle $\theta_2$ formed by the subsequent portions 34*c* and 34*d*. Accordingly, upon compression of the second compression spring 34, the forward end 34*a* thereof extends outwardly from the peripheral portion of the second compression spring 34 as is most clearly seen in FIG. 4(*b*). The forward end 34*a* of the second compression spring 34 as described above is arranged to contact an inner peripheral face of a protruding portion 29b extending outwardly from the peripheral edge of the dish-like contact plate 29 and also the bottom surface 29a of the contact plate 29, while the rear end at the base portion of the second compression spring 34 is fitted over a portion projecting from the main portion of the bush member 24 up to the contact portion 26 of the lead wire 25 as shown in FIG. 3, and upon depression of the bush member 24 in a direction indicated by the arrow 35 under the above state, the second compression spring 34 is held under compression between the bush member 24 and the contact plate 29.

In the above arrangement according to the present invention, since the diameter D at the portion 34b of the second compression spring 34 is arranged to be larger than the diameter d at the subsequent portion 34c thereof as described earlier, during compression of the second compression spring 34, a boundary portion 36 between the portion 34b half a turn from the forward end 34a and the subsequent portion 34c contacts the inner peripheral surface of the metallic casing 21, while the forward end 34a of the spring 34 is relatively rotated about the boundary portion 36 with respect thereto in a direction indicated by the arrow 37.

Accordingly, the above described contact plate 29 is urged in the direction of a component force indicated by the arrow 38 and perpendicular to the inner peripheral surface of the metallic casing 21 for contact under pressure therewith by the spring force the portion 34b at half a turn from the forward end 34a of the second compression spring 34 for positive electrical conduction with the metallic casing 21. Meanwhile, since the spring force of the first compression spring 32 is arranged to be larger than the spring force of the second compression spring 34, the contact plate 29 also contacts under pressure the contact portion 26 of the lead wire 25 to establish electrical conduction with respect to said lead wire 25 also, and thus, when an electrical appliance (not shown) installed with the thermal fuse F is normally functioning, the lead wires 23 and 25 are electrically conducted with each other through an electrical path including the metallic casing 21, contact plate 29 and contact portion 26.

On the other hand, upon melting of the organic fusible member 30 through rising of the ambient temperature due to troubles in the electrical appliance, the fusible member 30 is crushed by the spring forces of the first compression spring 32 and second compression spring 34, with the first and second compression springs 32 and 34 returning to their relaxed states. In the above case, since the external diameter $d_1$ of the contact plate 29 is made smaller than the internal diameter $d_0$ of the metallic casing 21, the contact plate 29 pushed by the spring force of the second compression spring 34 smoothly moves within the metallic casing 21 with almost no sliding function with respect to the metallic casing 21 to be quickly spaced from the contact portion 26 for cutting off the electrical conduction between the lead wires 23 and 25. In the foregoing arrangement of the present invention, it is necessary to arrange that the contact plate 29 is positively pushed off from the contact portion 26 during melting of the organic fusible member 30, for example, by setting the relaxed length of the second compression spring 34 to be larger than the distance between the contact portion 26 and the bottom portion 21a of the metallic casing 21. Furthermore, it is preferable to apply plating of precious metals such as gold, silver or the like to the inner surface of the metallic casing 21, contact portion 26, contact plate 29, etc. for reduction of contact resistance between the contact plate 29, metallic case 21 and contact portion 26.

Figure 5:
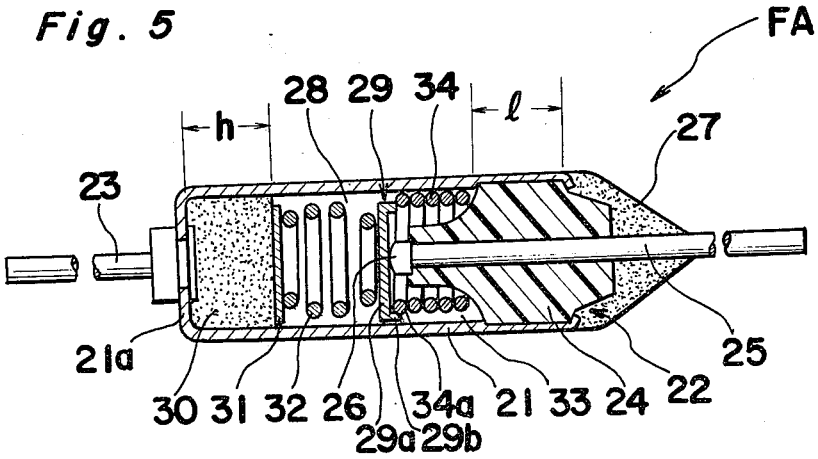
FIG. 5 is a view similar to FIG. 2, which particularly shows a modification thereof, FIGS. 6(*a*), 6(*b*) and 6(*c*) are side sectional views showing on an enlarged scale, modifications of the contact plate employed in the arrangements of FIGS. 2 and 5.

Referring to FIG. 5, there is shown a modification of the thermal fuse F of FIG. 2. In the modified thermal fuse FA of FIG. 5, the positions of the organic fusible member 30 and the first compression spring 32 are reversed as compared with the arrangement of FIG. 2, with the fusible member 30 being disposed to contact the bottom portion 21a of the metallic case 21, while the first compression spring 32 is held under compression in the space between the bottom portion 29a of the contact plate 29 and the washer plate 31 contacting said fusible member 30. Since other construction, function and effect of the heat fuse FA of FIG. 5 are exactly the same as those in the arrangement of FIG. 2, detailed description thereof is abbreviated for brevity.

Figure 6A:
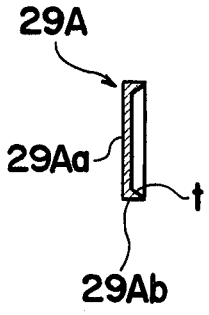
Figure 6B:
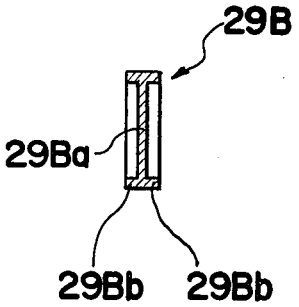
Figure 6C:
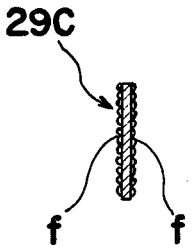

It should be noted here that the concept of the present invention is not limited in its application to the foregoing embodiment of FIGS. 2 and 5 alone, but various changes and modifications are possible within the scope. For example, the contact plate 29 described as employed in the arrangements of FIGS. 2 and 5 may be replaced by a contact plate 29A as shown in FIG. 6(a) having a tapered portion t at the inner peripheral surface of the protrusion 29Ab extending perpendicular to the edge of the bottom portion 29Aa, or by a contact plate 29B as shown in FIG. 6(b) having protrusions or rim portions 29Bb extending in both directions from the bottom portion 29Ba (in this case, the contact plate 29B is free from directivity or limitation in the orientation thereof), or by a contact plate 29C of flat plate-like shape as shown in FIG. 6(c) preferably roughened on its opposite surfaces f for causing the end edge (not shown) of the forward end 34a of the second compression spring 34 to cut or eat into the corresponding one of the surfaces f so as to bring the contaact plate 29C into positive contact with the inner surface of the metallic casing 21 under pressure.

It should further be noted that the protrusion 29b and the like described as extending from the peripheral edge of the bottom portion 29a in the foregoing embodiment may be further modified to extend from a portion between the central portion and peripheral portion of the contact plate 29, and in the above case, even if the diameter D at the portion 34b of the second compression spring 34 at least half a turn from the forward end 34a is arranged to be smaller than the diameter d at its adjacent portion 34c and the angle $\theta$, formed by the portion 34b and the adjacent portion 34c is larger than the angle $\theta_2$ formed by the subsequent portions 34c and 34d, the contact plate 29 can be brought into pressure contact with inner peripheral surface of the metallic casing 21. In other words, any spring so constructed as to produce a component force at its end in the direction perpendicular to the direction of its compression may be used as the second compression spring for the present invention.

Figure 7:
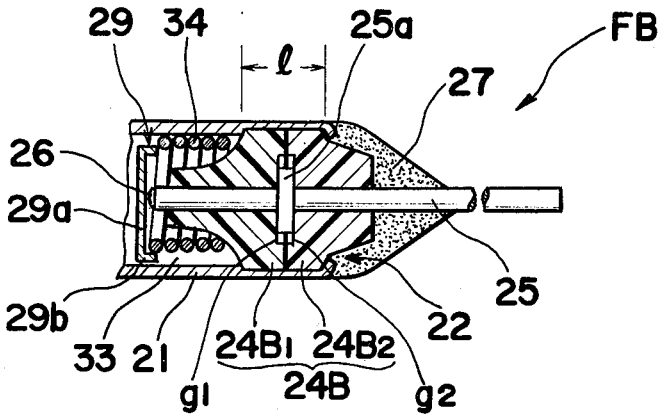
FIG. 7 is a fragmentary side sectional view showing the construction of a modified thermal fuse according to the present invention.

Referring to FIG. 7, there is shown a further modification of the thermal fuse F of FIG. 2. In the modified thermal fuse FB of FIG. 7, the bush member 24 described as employed in the arrangement of FIG. 2 is replaced by a bush member 24B which can be divided into two portions $24B_1$ and $24B_2$ by a plane perpendicular to the axis of the bush member 24B. The portions $24B_1$ and $24B_2$ are provided with recesses $g_1$ and $g_2$ respectively which define a circular space in the bush member 24 when combined for receiving therein a collar portion 25*a* formed on the lead wire 25. In the arrangement as described above, the lead wire 25 is free from any axial movement even if the bonding between the lead wire 25 and sealing resin 27 is insufficient, and thus, the undesirable re-conduction between the lead wires 23 and 25 due to contact of the contact portion 26 with the contact plate 29 after melting of the organic fusible member 30 can be perfectly prevented. In the above construction of FIG. 7, the diameter of the contact portion 26 at the forward end of the lead wire 25 should not be made larger than the diameter of the lead wire 25 from the viewpoint of manufacturing convenience.

Figure 8:
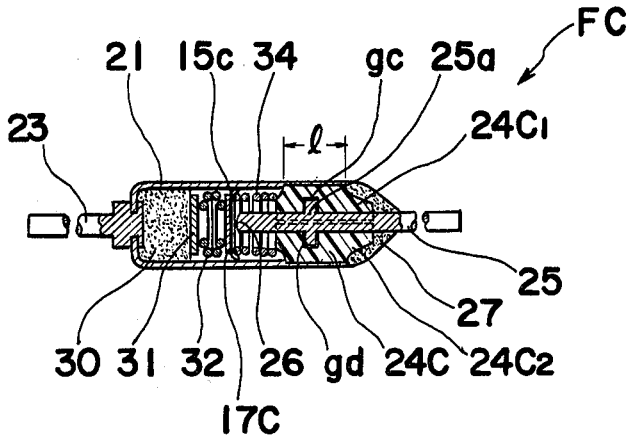
FIG. 8 is a view similar to FIG. 5 on a reduced scale, which particularly shows another modification thereof.
Figure 9:
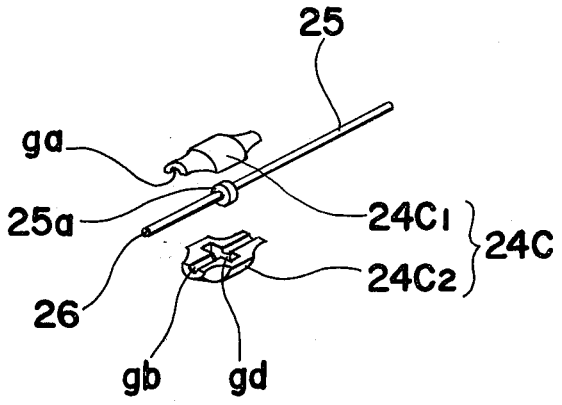
FIG. 9 is an exploded view showing the structure of a bush member or end plug employed in the arrangement of FIG. 8.

In FIG. 8, there is shown a still further modification of the arrangement of FIG. 5. In the modified thermal fuse FC of FIG. 8, the contact plate 29 described as employed in the arrangement of FIG. 5 is replaced by a slidable contact member 15C and a disc member or washer plate 17C, while the bush member 24 is also replaced by a bush member 24C, shown in FIG. 9, of ceramic material or the like, which is arranged to be divided into two portions $24C_1$ and $24C_2$ at a plane parallel to and including the axis thereof. On the contact faces of the portion $24C_1$ and $24C_2$, grooves ga and gb of semi-circular cross section each having a radius approximately equal to the radius of the lead wire 25 are respectively formed to provide a bore for passing the lead wire 25 therethrough in the bush member 24C when the portions $24C_1$ and $24C_2$ are combined, with the radius of each of the grooves ga and gb at their approximately central portions being made larger than that in the remaining portions to provide recesses gc and gd for fitting thereinto the collar portion 25*a* of the lead wire 25. By the above arrangement also, the lead wire 25 is retained at its collar portion 25*a*, and even if external force is applied to the lead wire 25 in the axial direction of the bush member 24 after spacing of the slidable contact member 15C from the contact portion 26 upon collapsing of the orgaic fusible member 30, the lead wire 25 is prevented from movement, and thus, the undesirable re-conduction between the lead wires 23 and 25 due to contact of the contact portion 26 with the slidable contact member 15C is advantageously prevented. In the foregoing arrangement, it is needless to say that the slidable contact member 15C and washer member 17 may be replaced by the contact plate 29 as described with reference to FIG. 5.

It is to be noted here that the material of the bushing member 24C is not limited to be of ceramic material, but may be replaced by resin material such as plastics and the like, in which case, the bush member of resin material can be integrally formed with the lead wire for example, by insert mold, etc., and that the collar portion 25*a* described as formed on the lead wire 25 is not restricted to be of circular shape, but may be modified to a polygonal configuration or to a mere protrusion radially outwardly extending from the outer periphery of the lead wire.

It should also be noted that the concept of the present invention is not limited in its application to the thermal fuse alone, but may be readily applicable to various other electrical parts such as switches depending on necessity.

Since other construction, function and effect of the thermal fuses FB and FC of FIGS. 7 and 8 are similar to those of the thermal fuse F of FIG. 2, detailed description thereof is abbreviated for brevity.

As is clear from the foregoing description, in the arrangement according to the present invention, since the contact plate having a diameter smaller than the internal diameter of the metallic casing is adapted to positively contact under pressure the peripheral inner surface of the metallic casing by the component force produced at the forward end of the second compression spring and applied in the direction perpendicular to the direction of the compression force, the contact plate can be pressed against the inner peripheral surface of the metallic casing with a sufficiently large contact pressure by the component force of the second compression spring, while the friction caused by the sliding movement of the contact plate with respect to the casing during functioning is extremely small owing to the diameter of the contact being made smaller than the internal diameter of the metallic casing which feature permits reduction of size of the heat fuse.

Furthermore, by the provision of the collar portion or retaining projection at the portion of the lead wire where it extends through the bush member, not only are the inconveniences due to axial movement of the lead wire eliminated, but it is unnecessary to make the diameter of the contact portion larger than the diameter of the remaining portion of the lead wire for the purpose of retaining the lead wire.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A thermal fuse for use in electrical and electronic equipment which comprises:

a metallic casing closed at one end and open at one end;

a first conductor extending outwardly from said closed end and being in electrical contact with said casing;

a second conductor having one end axially extending through said open end into the interior of said casing and electrically insulated therefrom, said second conductor having an electrical contact portion at said one end of said second conductor;

an end plug member of an electrically insulative material supporting said second conductor in and insulating said second conductor from said metallic housing;

a contact plate member accommodated in said casing;

a first spring;

a fusible member which is of a material that will melt at a temperature exceeding a predetermined temperature, said first spring and said fusible member being accommodated between said electrical contact portion of said second conductor and said closed end of said metallic casing; and a second spring disposed in said open end of said casing, and being electrically insulated from said second conductor, and further having one end free for engaging said contact plate member, said first and second springs having respective first, compressed positions when said fusible member is solid, wherein said springs are both compressed and said second spring exerts a force to urge said contact plate member away from said electrical contact portion of said second conductor and said first spring exerts a larger force to urge said contact plate member against said electrical contact portion, whereby said plate member and said contact portion are in mechanical and electrical contact when said springs are in said first position; and said springs further having respective second, relaxed positions when said fusible member is melted, such that in said second positions, said second spring holds said contact plate member out of electrical contact with said electrical contact member; said second spring further being so constructed that the force it exerts on said contact plate member has a component directed toward the interior wall of said casing so that in said first portion said plate member is in electrical contact with said interior wall of said casing.

2. A thermal fuse as claimed in claim 1, wherein said end plug member is made of ceramic material.

3. A thermal fuse as claimed in claim 1, wherein said end plug member is made of resin material, with the second conductor being integrally molded in said end plug member through insert molding.

4. A thermal fuse as claimed in claim 1, wherein said second conductor has a protrusion formed on it, and wherein said end plug member comprises two portions divided by a plane perpendicular to the axis of said end plug member, with corresponding recesses in mating surfaces of said two portions for accommodating therein said second conductor and said protrusion when said two portions are combined with each other, to prevent axial movement of said second conductor with respect to said end plug member.

5. A thermal fuse as claimed in claim 1, wherein said second conductor has a protrusion formed on it, and wherein said end plug member comprises two portions divided by a plane parallel to and including the axis of said end plug member, with corresponding recesses in mating surfaces of said two portions for accommodating therein said second conductor and said protrusion when said two portions are combined with each other, to prevent axial movement of said second conductor with respect to said end plug member.

6. A thermal fuse as claimed in claim 1, wherein said contact plate member has a disc-like configuration and an external diameter smaller than the internal width of said metallic case and is provided with an annular member on one principal side of said contact plate member.

7. A thermal fuse as claimed in claim 1, wherein said contact plate member has a disc-like configuration and an external diameter smaller than the internal width of said metallic case, and has one principal surface roughened to receive one end of said second spring.

8. A thermal fuse as claimed in claim 1, further comprising an insulative end plug disposed in said open end of said casing, said second conductor extending through said end plug.

9. A thermal fuse as claimed in claim 1, wherein said second spring comprises a first portion including at least the first half-turn from said end of said second spring and having a first diameter, and a second portion adjacent said first portion and having a second diameter less than said first diameter, the axis of said second portion being pitched at an angle to the axis of said first portion.

10. A thermal fuse as claimed in claim 1, wherein the wall of said casing is turned inward at said open end thereof.

11. A thermal fuse as claimed in claim 10, further comprising a sealing resin material disposed at said open end for further sealing said end plug in place.

12. A thermal fuse as claimed in claim 1, wherein said electrical contact portion of said second conductor is provided with a layer of a highly conductive metal to ensure low-resistance contact between said electrical contact portion and said contact plate member.

13. A thermal fuse as claimed in claim 1, wherein said first spring in said first position is disposed between said fusible member and said contact plate member and in mechanical contact with the latter.

14. A thermal fuse as claimed in claim 1, wherein said fusible member is disposed between said first spring and said contact plate member and in mechanical contact with the latter.

* * * * *